US008521072B2

(12) United States Patent
You et al.

(10) Patent No.: US 8,521,072 B2
(45) Date of Patent: Aug. 27, 2013

(54) IMAGE FORMING APPARATUS AND COLOR REGISTRATION METHOD THEREOF

(75) Inventors: Yong Ho You, Suwon-si (KR); Hae Seog Jo, Yongin-si (KR); Myong Hun Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 676 days.

(21) Appl. No.: 12/654,972

(22) Filed: Jan. 11, 2010

(65) Prior Publication Data

US 2010/0178069 A1 Jul. 15, 2010

(30) Foreign Application Priority Data

Jan. 12, 2009 (KR) ..... 10-2009-0002188

(51) Int. Cl.
*G03G 15/01* (2006.01)

(52) U.S. Cl.
USPC ..... 399/301; 399/39

(58) Field of Classification Search
USPC ..... 399/39, 301; 347/116
See application file for complete search history.

(56) References Cited

U.S. PATENT DOCUMENTS

2006/0182472 A1* 8/2006 Munakata et al. ..... 399/299

FOREIGN PATENT DOCUMENTS

JP 2008-76534 4/2008

* cited by examiner

*Primary Examiner* — Walter L Lindsay, Jr.
*Assistant Examiner* — Ruth Labombard
(74) *Attorney, Agent, or Firm* — Staas & Halsey LLP

(57) ABSTRACT

An image forming apparatus and a color registration method thereof. The color registration method includes checking a change in a status of an image forming apparatus, selecting color registration patterns having a different length according to the status change, and performing color registration by printing the color registration patterns having the different length onto a transfer belt.

15 Claims, 9 Drawing Sheets

IMAGE FORMING APPARATUS AND COLOR REGISTRATION METHOD THEREOF

CROSS-REFERENCE TO RELATED APPLICATION

This application claims the benefit of Korean Patent Application No. 10-2009-0002188, filed in the Korean Intellectual Property Office on Jan. 12, 2009, the disclosure of which is incorporated herein by reference.

BACKGROUND OF THE INVENTION

1. Field of the Invention

Aspects of one or more embodiments relate to an electrophotographic image forming apparatus to perform color registration using different patterns in different operation modes and a color registration method thereof.

2. Description of the Related Art

A traditional electrophotographic image forming apparatus (such as a laser printer, a digital copier, etc.) forms an electrostatic latent image on the surface of a photosensitive medium charged with a predetermined potential by scanning light onto the photosensitive medium, develops the electrostatic latent image into a visible image by applying a toner as a developing agent to the electrostatic latent image, and transfers and fixes the developed image onto a piece of paper. An electrophotographic color image forming apparatus creates a color image by supplying four colors of toners (black K, yellow Y, magenta M, and cyan C) to a photosensitive medium and overlapping the resulting different color images with one another.

Two color image creation schemes are generally available for the electrophotographic color image forming apparatus: a single-pass type using four optical scanning units and four photosensitive media, and a multi-pass type using a single optical scanning unit and a single photosensitive medium. When the electrophotographic color image forming apparatus, especially the single-pass electrophotographic color image forming apparatus, fails to accurately overlap the images of different colors at intended positions, image quality is degraded, as is the case with blurs at the edges of a color image. As this occurs due to interaction between a plurality of factors including developer replacement, an increased number of printed papers, etc., color registration may be required to align the images of the respective colors with one another. In this context, the single-pass color image forming apparatus is configured to create high-quality color images through Auto Color Registration (ACR) that triggers color registration automatically, each time various composite factors occur, such as developer replacement, an increase in the number of pieces of printed papers, and the like.

To implement the ACR, the single-pass color image forming apparatus prints ACR patterns of a predetermined length (offset correction patterns for black K, yellow Y, magenta M, and cyan C for use in color registration) on a transfer belt and receives light reflected from each color offset correction pattern through an ACR sensor, thereby recognizing the toner transfer position of each color. With respect to the position of one reference color (e.g. black), the positions of the other colors are adjusted based on the sensed toner transfer positions, such that the images of the respective colors are aligned overlapped at correction positions. However, the ACR patterns of the predetermined length should be printed on a transfer belt for each color registration, taking a large amount of toner. The resulting increased ACR process time does not satisfy user convenience.

SUMMARY OF THE INVENTION

Aspects of one or more embodiments to provide a method to perform color registration using ACR patterns of different lengths in different operation modes in a single-pass color image forming apparatus.

According to an aspect of one or more embodiments, a color registration method is provided. The method includes detecting a change in a status of an image forming apparatus, selecting color registration patterns having a different length according to the detected status change, and performing color registration by printing the selected color registration patterns having the different length onto a transfer belt.

According to another aspect of one or more embodiments, the color registration method may further include determining a current operation mode for the color registration, wherein the current operation mode is one of a plurality of operation modes, the plurality of operation modes including a first operation mode in which the color registration is performed under a condition of replacement of a consumable part and a second operation mode in which the color registration is performed under a condition other than replacement of a consumable part.

According to another aspect of one or more embodiments, the condition of replacement of the consumable part may be that a toner transfer position for each color is misaligned along an X-axis direction perpendicular to a transfer direction of the transfer belt by at least a predetermined number of dots due to replacement of a developer or the transfer belt.

According to another aspect of one or more embodiments, the condition other than replacement of the consumable part may be that a toner transfer position for each color is misaligned along an X-axis direction perpendicular to a transfer direction of the transfer belt by less than a predetermined number of dots due to an increase in the number of printed papers, a temperature change of a set, or power on/off.

According to another aspect of one or more embodiments, the color registration patterns may be offset correction patterns for a plurality of colors for use in the color registration.

According to another aspect of one or more embodiments, the offset correction patterns may include a color registration pattern for X-axis offset correction in the first operation mode and a color registration pattern for X-axis offset correction in the second operation mode.

According to another aspect of one or more embodiments, the color registration patterns for the first and second operation modes may have different horizontal lengths.

According to another aspect of one or more embodiments, the horizontal length of the color registration pattern of the first operation mode may be set according to the X-axis offset deviation prior to the color registration.

According to another aspect of one or more embodiments, the horizontal length of the color registration pattern of the second operation mode may be set according to the X-axis offset deviation after the color registration.

According to another aspect of one or more embodiments, the horizontal length of the color registration pattern of the second operation mode may be set to be shorter than the horizontal length of the color registration pattern of the first operation mode.

According to another aspect of one or more embodiments, the color registration may include correcting positions of other colors with respect to a position of one reference color among a plurality of colors and aligning images of the colors to overlap with one another at the corrected positions.

According to another aspect of one or more embodiments, the color registration method may further include measuring a velocity change of the transfer belt, and the color registration may include changing positions of the color registration patterns according to the velocity change of the transfer belt.

According to another aspect of one or more embodiments, the color registration method may further include changing a length of the color registration patterns for each of the plurality of operation modes, and the color registration may include printing the color registration patterns of the changed length according to the current operation mode.

According to another aspect of one or more embodiments, an image forming apparatus is provided. The image forming apparatus includes a storage unit to store different color registration patterns having different lengths for a plurality of operation modes for color registration, a controller to select color registration patterns of a different length according to a current operation mode, and a printer to print the selected color registration patterns onto a transfer belt so as to perform the color registration.

According to another aspect of one or more embodiments, the controller may measure a velocity change of the transfer belt and perform the color registration by changing positions of the color registration patterns according to the velocity change of the transfer belt.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
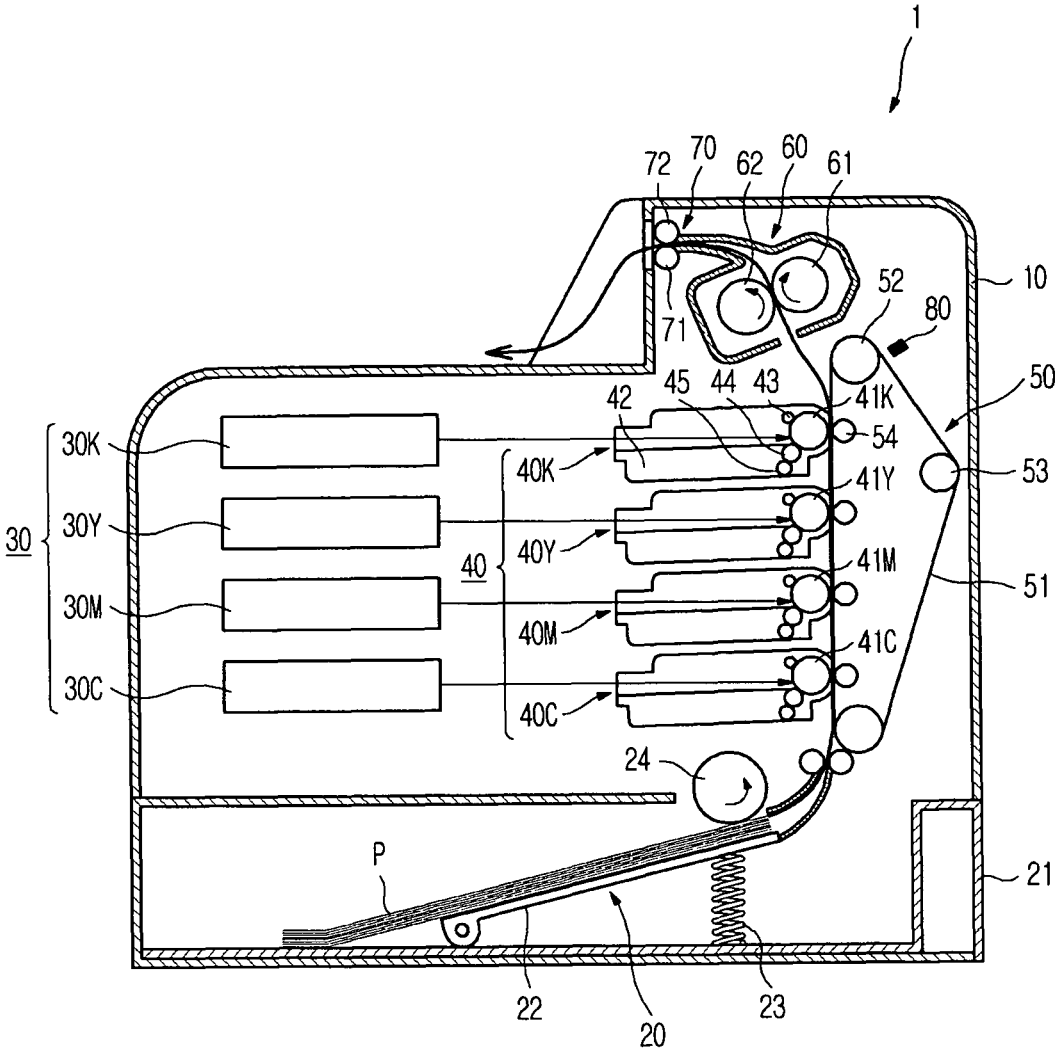
FIG. 1 illustrates the configuration of a color image forming apparatus according to an embodiment.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 illustrates the configuration of a color image forming apparatus 1 according to an embodiment. As shown, the single-pass color image forming apparatus 1 to create a color image by sequentially transferring toner images of different colors overlappingly onto a piece of paper P. The single-pass color image forming apparatus 1 includes, within a body 10 forming its exterior, a paper feeding unit 20, optical scanning units 30, a development unit 40, a transfer unit 50, a fixing unit 60, a paper discharge unit 70, and a sensor unit 80. According to other aspects of one or more embodiments, the single-pass color image forming apparatus 1 may include additional and/or different units. Similarly, the functionality of two or more of the above units may be integrated into a single component. Moreover, aspects of one or more embodiments can be implemented using other types of color image forming apparatuses, such as a multi-purpose type color image forming apparatus The paper feeding unit 20 is provided with a paper feeding cassette 21 detachably mounted to a bottom of the body 10, a paper pressing plate 22 on which the paper P is stacked, an elastic member 23 under the paper pressing plate 22, and a pick-up roller 24 positioned at a leading end of the paper P stacked on the paper pressing plate 22. The paper pressing plate 22 is rotatable upward and downward within the paper feeding cassette 21. The elastic member 23 elastically supports the paper pressing plate 22. The pick-up roller 24 picks up the paper P from the paper pressing plate 22.

The optical scanning units 30 (or 30K, 30Y, 30M and 30C) scans light corresponding to image information of different colors, for example, black K, yellow Y, magenta M and cyan C onto the development unit 40. A Laser Scanning Unit (LSU) using a laser diode as a light source may be used for the optical scanning units 30. As shown, the apparatus 1 uses four colors, but aspects of one or more embodiments are not limited to the shown colors, and is also usable with different numbers of colors.

The development unit 40 includes four developers 40K, 40Y, 40M and 40C to accommodate toners of different colors (for example, black K, yellow Y, magenta M, and cyan C toners) therein. The developers 40K, 40Y, 40M and 40C respectively include photosensitive media 41K, 41Y, 41M and 41C on which electrostatic latent images are formed by the optical scanning units 30. While the photosensitive media 41K, 41Y, 41M and 41C are installed in the developers 40K, 40Y, 40M and 40C in the illustrated case of FIG. 1, they may be provided separately from the developers 40K, 40Y, 40M and 40C in the body 10.

Each of the developers 40K, 40Y, 40M and 40C has a toner storage 42 having toner, a charge roller 43, a development roller 44 to develop an electrostatic latent image formed on a photosensitive medium to a toner image, and a supply roller 45 to supply the toner to the development roller 44.

The transfer unit 50 transfers toner images developed on the photosensitive media 41K, 41Y, 41M, and 41C onto the paper P. The transfer unit 50 is provided with a Paper Transfer Belt (PTB) 51 that goes around in contact with the photosensitive media 41K, 41Y, 41M and 41C, a driving roller 52 that drives the PTB 51, a support roller 53 that maintains the tensile force of the PTB 51, and four transfer rollers 54 that transfer the toner images from the photosensitive media 41K, 41Y, 41M and 41C to the paper P.

The fixing unit 60 fixes the toner images onto the paper P by heat and pressure. The fixing unit 60 includes a heating roller 61 and a pressing roller 62. The heating roller 61 has a heating source to heat the paper P with the toner transferred thereon. The pressing roller 62 faces the heating roller 61 to maintain a fixing pressure at a predetermined level with respect to the heating roller 61.

The paper discharge unit 70 discharges the printed paper P outside the body 10. The paper discharge unit 70 includes a discharge roller 71 and a back-up roller 72 that rotates along with the discharge roller 71.

The sensor unit 80 senses toner transfer positions of ACR patterns printed on the transfer belt 51, for color registration. The sensor unit 80 includes an optical sensor including a light emitter and a light receiver. The optical sensor projects light toward the transfer belt 51 before the light emitter along an X-axis direction. The light receiver receives the light reflected from the transfer belt 51. The sensor unit 80 detects the toner transfer positions of the ACR patterns by receiving the light reflected from toner layers of the ACR patterns (offset correction patterns for the respective colors) printed on the transfer belt 51. Because color registration may differ in one end portion and the other end portion of the transfer belt 51 along a width direction of a color image due to the scanning skews of the optical scanners 30, the light receiver is positioned at both ends of the transfer belt 51.

Figure 2:
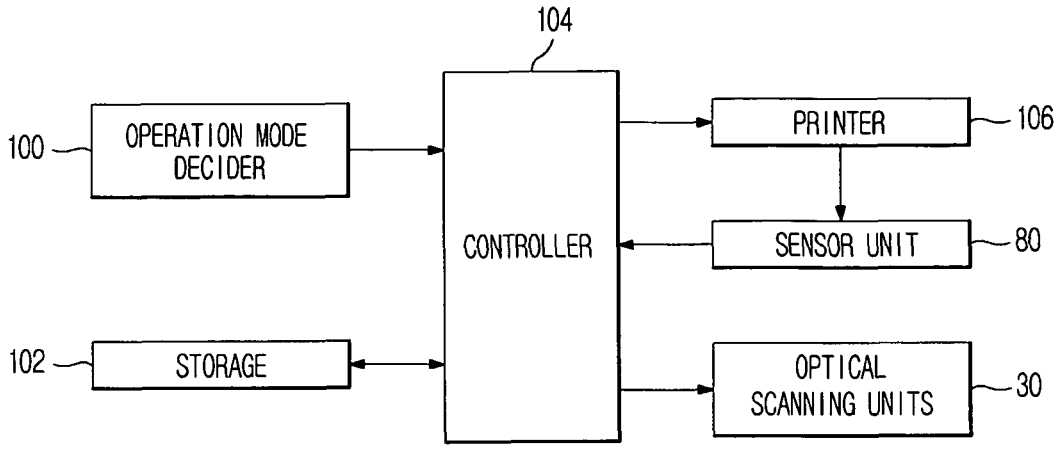
FIG. 2 is a control block diagram of the color image forming apparatus to perform color registration according to an embodiment.

FIG. 2 is a control block diagram of the color image forming apparatus to perform color registration according to an embodiment. The color image forming apparatus includes an operation mode decider 100, a storage unit 102, a controller 104, and a printer 106. While not required in all aspects, the decoder 100 and controller 104 can be implemented on one or more processors and/or computers, and may be implemented using software and/or firmware stored on one or more computer readable media.

The operation mode decider 100 selects an operation mode in which color registration is to be performed in the single-pass color image forming apparatus 1. The operation mode may be a first operation mode or a second operation mode. In the first operation mode, ACR is performed under the condition that the toner transfer position for each color is greatly out of alignment by at least a predetermined number of dots due to replacement of a consumable part, such as the developers 40K, 40Y, 40M and 40C or the transfer belt 51. In the second operation mode, ACR is performed under the condition that the toner transfer position for each color is slightly out of alignment by fewer than a predetermined number of dots due to variations in set conditions other than replacement of a consumable part, such as an increase in the number of printed papers, a temperature change of a set, power on/off, and the like.

The storage 102 sets and stores ACR patterns of a different horizontal length according to the ACR operation mode used. The storage 102 sets the horizontal length of the ACR patterns (the X-axis length of offset correction patterns) shorter in the second operation mode than in the first operation mode. The reason for using the shorter ACR patterns in the second operation mode is to reduce toner consumption and an ACR process time by changing the horizontal length of the ACR patterns according to the used operation mode, considering the fact that the misalignment of the toner transfer positions is less in the second operation mode than in the first operation mode. While not required in all aspects, the storage 102 can be magnetic and/or optical media, and can be rewritable as in the case that the ACR patterns are updated.

The ACR patterns are offset correction patterns corresponding to the four colors, black K, yellow Y, magenta M and cyan C for color registration. These ACR patterns may take various shapes. According to aspects of one or more embodiments, the ACR patterns are set to correct offset deviations in X-axis and Y-axis directions, taking into account X-axis and Y-axis misalignments of the toner transfer positions depending on whether a consumable part (such as the developer 40K, 40Y, 40M, or 40C, or the transfer belt) is replaced. To this end, the horizontal of the ACR patterns is changed depending on whether the consumable part is replaced with a new one, which will be described later with reference to FIGS. 3 and 4. As shown, the X axis is horizontal, and the Y axis is parallel to a moving direction of the paper.

The controller 104 selects the ACR patterns for use in X-axis and Y-axis offset correction from the storage 102 to perform color registration according to the operation mode of the color image forming apparatus 1 decided by the operation mode decider 100. The controller 104 provides the selected ACR patterns to the printer 106 so that the printer 106 prints the ACR patterns.

The printer 106 prints the selected ACR patterns on the transfer belt 51. The sensor unit 80 senses the toner transfer positions of the ACR patterns and notifies the controller 104 of the sensed toner transfer positions. The controller 104 performs the ACR according to the toner transfer positions of the ACR patterns to calibrate color registration by controlling the optical scanners 30K, 30Y, 30M and 30C such that images of the respective colors are overlapped at accurate positions.

Figure 3:
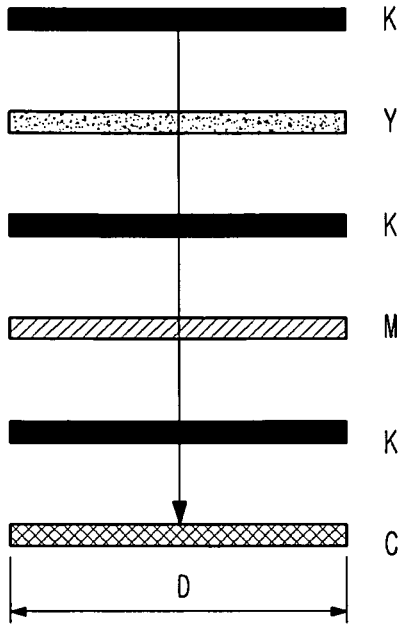
FIG. 3 illustrates ACR patterns with which Y-axis offsets are corrected in a first operation mode in the color image forming apparatus according to an embodiment.
Figure 4:
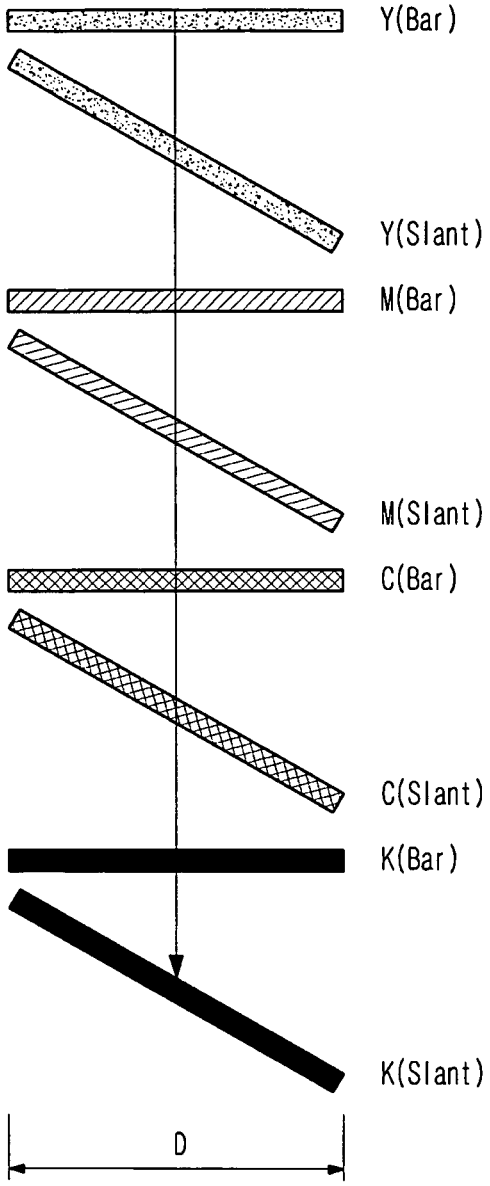
FIG. 4 illustrates ACR patterns with which X-axis offsets are corrected in the first operation mode in the color image forming apparatus according to an embodiment.

FIG. 3 illustrates ACR patterns with which Y-axis offsets are corrected in the first operation mode in the color image forming apparatus according to an embodiment. FIG. 4 illustrates ACR patterns with which X-axis offsets are corrected in the first operation mode in the color image forming apparatus according to an embodiment.

Referring to FIGS. 3 and 4, the horizontal lengths D of the ACR patterns for use in X-axis and Y-axis offset correction are equal. The horizontal length D of the ACR patterns for the first operation mode may be computed by $$D/2=A+B+C \quad \text{[Equation 1]}$$

where A denotes a left margin deviation (generally about 1.5 mm) along a main scanning direction of a reference color (e.g. black) among the four colors, black K, yellow Y, magenta M and cyan C, with respect to a maximum deviation that may occur in the X-axis direction (i.e. the main scanning direction) when the developers 40K, 40Y, 40M and 40C are mounted initially, B denotes a pre-ACR correction X-axis offset deviation (generally about 2.5 mm) between the reference color (black) and the other colors (e.g. yellow, magenta, and cyan), and C denotes the beam diameter (generally about 1.5 mm) of the optical sensor being the optical sensor unit.

Referring to FIG. 4, as ACR patterns for X-axis offset correction, a bar pattern along a horizontal direction and a slant pattern inclined from the horizontal direction by a predetermined angle are formed for each color. Therefore, the toner transfer position of each color may be adjusted by as many X-axis dots as misaligned based on the differences between the bar-slant pattern interval of the reference color (black) and the bar-slant pattern intervals of the other colors (yellow, magenta, and cyan).

Figure 5:
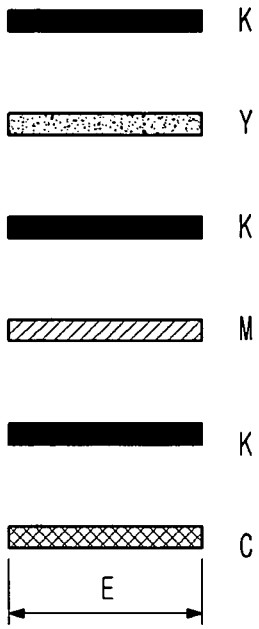
FIG. 5 illustrates ACR patterns with which Y-axis offsets are corrected in a second operation mode in the color image forming apparatus according to an embodiment.
Figure 6:
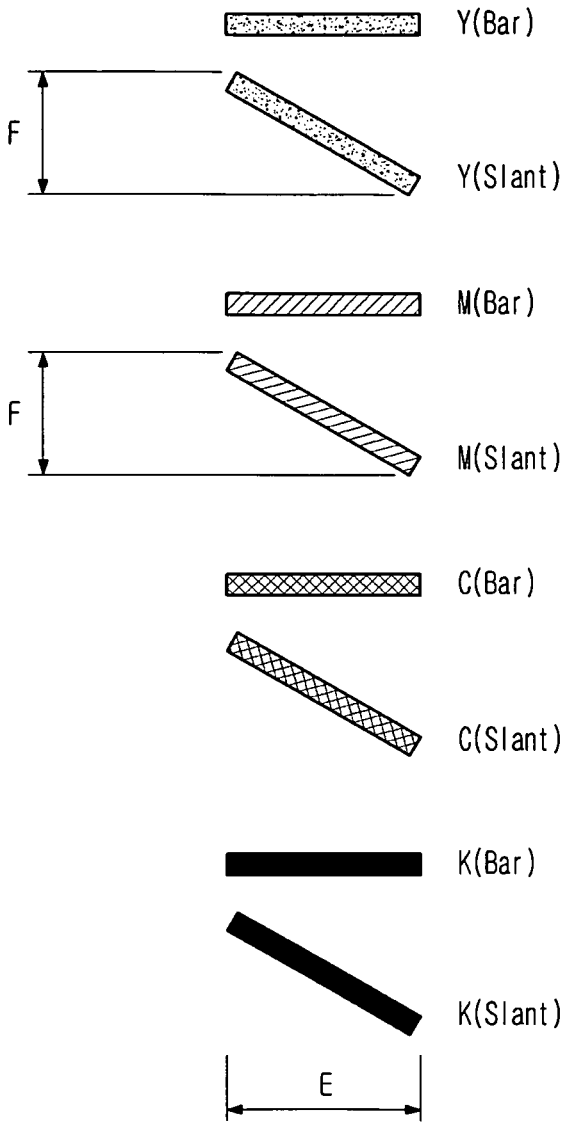
FIG. 6 illustrates ACR patterns with which X-axis offsets are corrected in the second operation mode in the color image forming apparatus according to an embodiment.

FIG. 5 illustrates ACR patterns with which Y-axis offsets are corrected in the second operation mode in the color image forming apparatus according to an embodiment. FIG. 6 illustrates ACR patterns with which X-axis offsets are corrected in the second operation mode in the color image forming apparatus according to an embodiment.

Referring to FIGS. 5 and 6, the horizontal lengths E of the ACR patterns for use in X-axis and Y-axis offset correction are equal. The horizontal length E of the ACR patterns for the second operation mode may be computed by $$E/2=A+B'+C \quad \text{[Equation 2]}$$

where A denotes a left margin deviation (generally about 1.5 mm) along the main scanning direction of the reference color (e.g. black) among the four colors, black K, yellow Y, magenta M and cyan C, with respect to a maximum deviation that may occur in the X-axis direction (i.e. the main scanning direction) when the developers 40K, 40Y, 40M and 40C are mounted initially, B' denotes an X-axis offset deviation (generally about 0.2 mm) between the reference color (black) and the other colors (e.g. yellow, magenta, and cyan), which may be caused by an increase in the number of printed papers and a temperature change of the set after ACR correction. C denotes the beam diameter (generally about 1.5 mm) of the optical sensor being the optical sensor unit 80. The values of A, B, B', and C are for purposes of example; aspects of one or more embodiments are not limited thereto.

Referring to FIG. 6, as ACR patterns for X-axis offset correction in the second operation mode, a bar pattern along the horizontal direction and a slant pattern inclined from the horizontal direction by a predetermined angle are formed for each color. As noted, because the horizontal length E of the ACR patterns for the second operation mode is shorter than the horizontal length D of the ACR patterns for the first operation mode, the longitudinal length F of the slant patterns is also shortened.

Because the positions of the other color images (yellow, magenta, and cyan) are corrected with respect to the position of the reference color image (black) by the ACR, the X-axis inter-set deviation A of the reference color (black) is not corrected even after the ACR. The X-axis deviations between the reference color (black) and the other colors (yellow, magenta, and cyan) include the main scanning-directional deviations B among the colors of the optical scanners 30K, 30Y, 30M and 30C when an ACR is initially performed, and are the deviations B' caused by a change in set conditions since an ACR is performed based on previous correction values after the ACR.

In a current set, B and B' are roughly given as follows.

B=2.5 mm and B'=0.2 mm (B>B')

Therefore, the horizontal length of the ACR patterns may be decreased by $$(B-B')\times 2=4.6 \text{ mm}$$

The horizontal length E (about 6.4 mm) of the ACR patterns calculated by [equation 2] in the second operation mode is about 58.2% shorter than the horizontal length D (about 11 mm) of the ACR patterns calculated by [equation 1] in the first operation mode.

Figure 7:
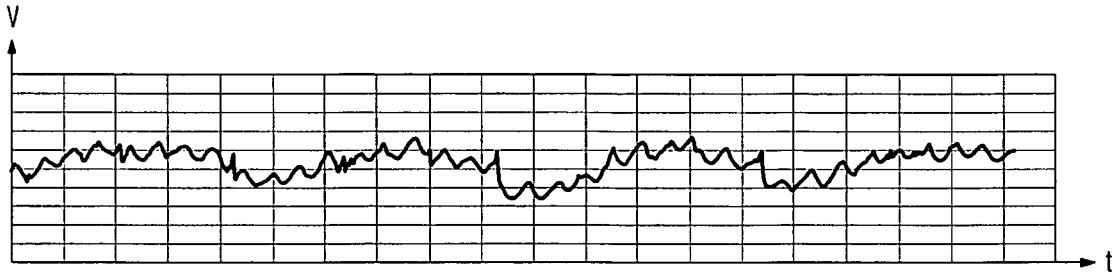
FIG. 7 is a graph illustrating variations in the velocity of a transfer belt in the color image forming apparatus according to an embodiment.

The ACR is performed mostly in the second operation mode in the color image forming apparatus 1. The use of the shorter horizontal length E of the ACR patterns leads to the reduction of toner consumption for each color during ACR and also to the decrease of the longitudinal length F of the slant patterns for X-axis color registration (refer to FIG. 6). The resulting decrease of the total Y-axis length of the ACR patterns shortens the total ACR process time. With respect to the X-axis offset correction patterns, since the sensing distance between a bar pattern and a slant pattern is reduced, the influence of a Y-axis velocity of the transfer belt 51 that is generated during rotation of the transfer belt 51 may be minimized, as illustrated in FIG. 7.

Figure 8:
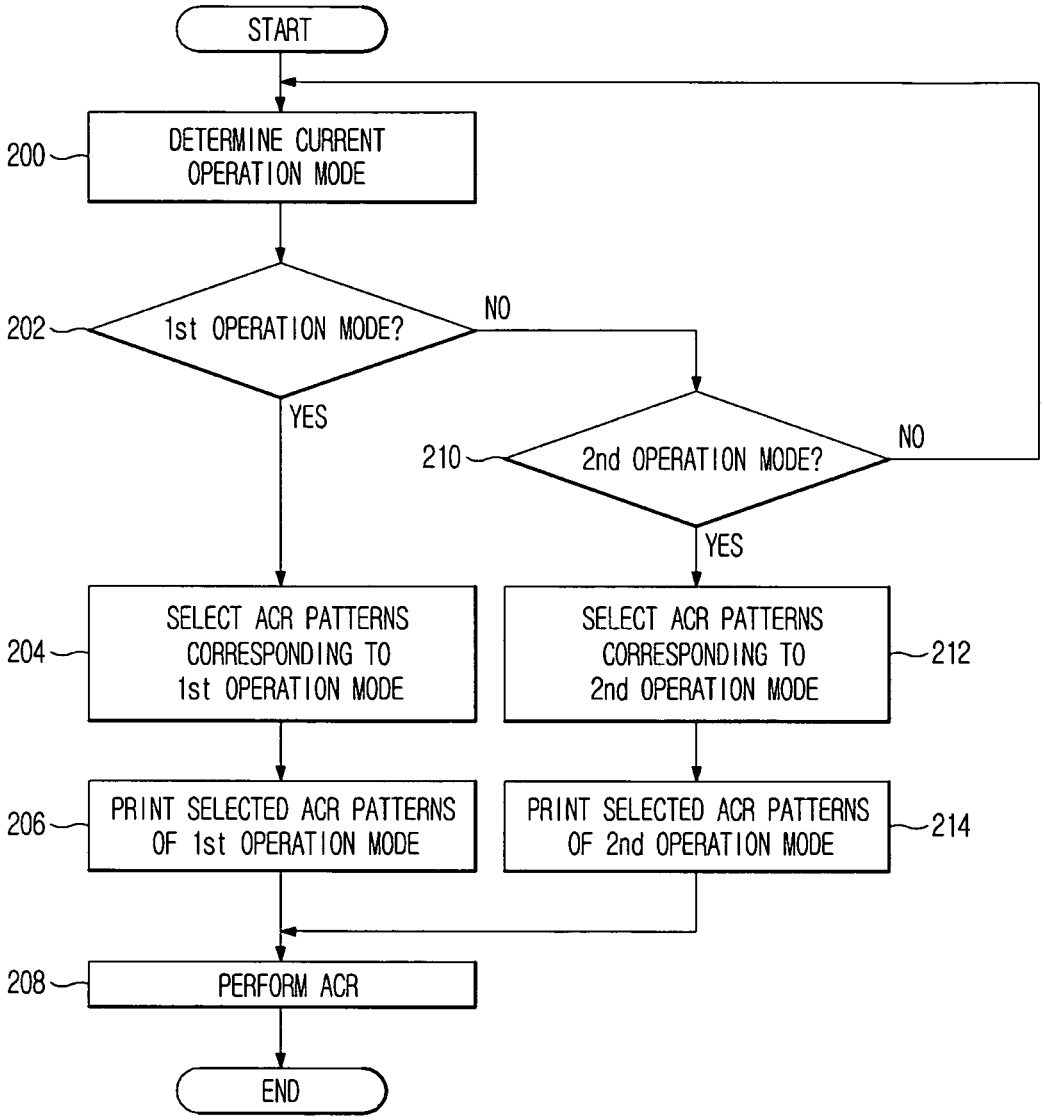
FIG. 8 is a flowchart illustrating a color registration method in the color image forming apparatus according to an embodiment.

FIG. 8 is a flowchart of a color registration method in the color image forming apparatus according to an embodiment. In operation 200, the single-pass color image forming apparatus 1 determines a current operation mode for color registration through the operation mode decider 100 by checking a status change caused by replacement of a consumable part (a developer or a transfer belt) or a change in set conditions. The operation mode may be a first operation mode in which an ACR is performed under the condition that the toner transfer position of each color is greatly misaligned by a predetermined number of or more dots because of replacement of a consumable part (such as the developers 40K, 40Y, 40M and 40C or the transfer belt 51), or a second operation mode in which an ACR is performed under the condition that the toner transfer position of each color is slightly misaligned by fewer than a predetermined number of dots because of operation errors or the like, without replacement of a consumable part.

In operation 202, the controller 104 determines whether the current operation mode is the first operation mode. In the case of the first operation mode, the controller 104 selects ACR patterns corresponding to the first operation mode as illustrated in FIGS. 3 and 4 from the storage 102 in operation 204. In operation 206, the controller 104 provides the first-operation mode ACR patterns to the printer 106 and controls the printer 106 to print the patterns onto the transfer belt 51. The optical sensor unit 80 at both end portions of the transfer belt 51 senses the toner transfer positions of the ACR patterns and notifies the controller 104 of the sensed toner transfer positions.

In operation 208, the controller 104 performs an ACR by controlling the optical scanning units 30 to overlap the images of the respective colors at correct positions according to the toner transfer positions of the ACR patterns, thereby calibrating color registration.

If the current operation mode is not the first operation mode in operation 202, the controller 104 determines whether the current operation mode is the second operation mode in operation 210. In the case of the second operation mode, the controller 104 selects ACR patterns corresponding to the second operation mode as illustrated in FIGS. 5 and 6 from the storage 102 in operation 212. In operation 214, the controller 104 provides the second-operation mode ACR patterns to the printer 106 and controls the printer 106 to print the patterns onto the transfer belt 51. The pair of sensor units 80 at both end portions of the transfer belt 51 sense the toner transfer positions of the ACR patterns and notifies the controller 104 of the sensed toner transfer positions.

In operation 208, the controller 104 performs an ACR by controlling the optical scanning units 30 to overlap the images of the respective colors at correct positions according to the toner transfer positions of the ACR patterns, thereby calibrating color registration.

As described above, different ACR operation modes may employ ACR patterns of different horizontal lengths according to the misalignment degrees of toner transfer positions caused by replacement or non-replacement of a consumable part. While shown with only two modes for purposes of simplicity, further modes can be defined to account for different color registration problems caused by specific events. According to other aspects of one or more embodiments, ACR patterns may be changed, taking into further account the velocity change of the transfer belt 51. This method will be described below with reference to FIG. 9.

Figure 9:
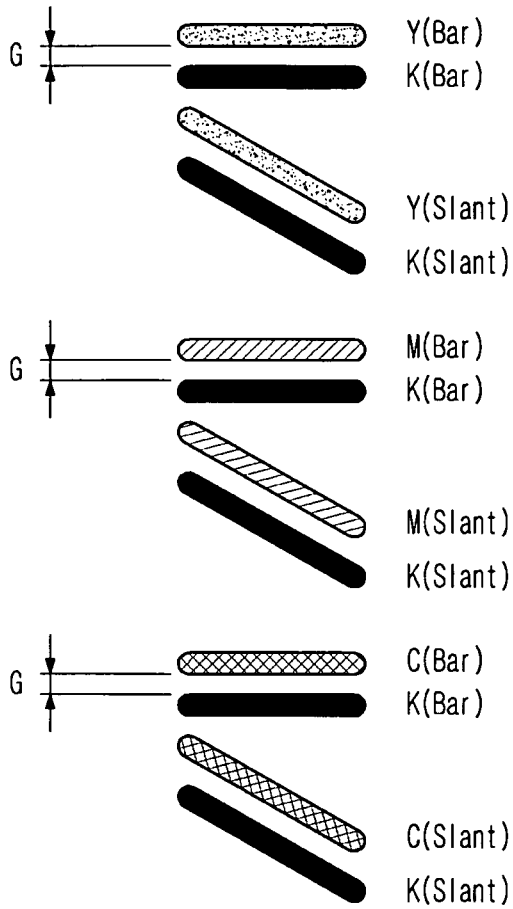
FIG. 9 illustrates ACR patterns with which X-axis offsets are corrected based on a change in the velocity of the transfer belt in the color image forming apparatus according to an exemplary embodiment.

FIG. 9 illustrates ACR patterns with which X-axis offsets are corrected according to a change in the velocity of the transfer belt in the color image forming apparatus according to an embodiment. As shown in FIG. 9, a bar pattern and a slant pattern for the reference color (black) are formed with a minimal distance to bar and slant patterns for the other colors (yellow, magenta and cyan).

The distance G between each black pattern and any other color pattern is determined based on the beam diameter of the sensor unit 80 and Y-axis offset deviations among the colors. When the reference-color patterns (the black patterns) are close to specific-color patterns (e.g. yellow patterns) in X-axis offset correction of yellow, the influence of the Y-axis velocity change of the transfer belt 51 caused by its rotation may be reduced. This is because the velocity change of the transfer belt 51 may need to be considered and the impact of the velocity change of the transfer belt 51 may need to be avoided as well, for Y-axis offset correction.

As is apparent from the above description, the single-pass color image forming apparatus performs color registration using ACR patterns of a different length according to an operation mode used. Therefore, toner consumption and an ACR process time are reduced. Also, the accuracy of the color registration is improved by changing the positions of the correction patterns according to a velocity change of the transfer belt when an ACR is performed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A color registration method comprising:

detecting a change in a status of an image forming apparatus;

determining a current operation mode for the color registration, wherein the current operation mode is one of a plurality of operation modes, including a first operation mode in which the color registration is performed under a condition of replacement of a consumable part and a second operation mode in which the color registration is performed under a condition other than replacement of a consumable part;

selecting color registration patterns having a different length according to the detected status change; and performing color registration by printing the selected color registration patterns having the different length onto a transfer belt, wherein the length of the color registration pattern of the second operation mode is set to be shorter than the length of the color registration pattern of the first operation mode, wherein the length of the color registration pattern is a length of an X-axis direction perpendicular to a transfer direction of the transfer belt.

2. The color registration method according to claim 1, wherein the condition of replacement of the consumable part is that a toner transfer position for each color is misaligned along the X-axis direction perpendicular to a transfer direction of the transfer belt by at least a predetermined number of dots due to replacement of a developer or the transfer belt.

3. The color registration method according to claim 1, wherein the condition other than replacement of a consumable part is that a toner transfer position for each color is misaligned along an X-axis direction perpendicular to a transfer direction of the transfer belt by fewer than a predetermined number of dots due to an increase in the number of printed papers, a temperature change of a set, or power on/off.

4. The color registration method according to claim 1, wherein the color registration patterns are offset correction patterns for a plurality of colors for use in the color registration.

5. The color registration method according to claim 4, wherein the offset correction patterns include a color registration pattern for X-axis offset correction in the first operation mode and a color registration pattern for X-axis offset correction in the second operation mode.

6. The color registration method according to claim 1, wherein the length of the color registration pattern of the first operation mode is set according to an X-axis offset deviation prior to the color registration.

7. The color registration method according to claim 1, wherein the length of the color registration pattern of the second operation mode is set according to an X-axis offset deviation after the color registration.

8. The color registration method according to claim 1, wherein the color registration comprises:

correcting positions of other colors with respect to a position of one reference color among a plurality of colors; and aligning images of the colors to overlap with one another at the corrected positions.

9. The color registration method according to claim 1, further comprising:

measuring a velocity change of the transfer belt;

wherein the color registration comprises changing positions of the color registration patterns according to the velocity change of the transfer belt.

10. The color registration method according claim 1, further comprising:

changing a length of the color registration patterns for each of the plurality of operation modes;

wherein the color registration comprises printing the color registration patterns of the changed length according to the current operation mode.

11. An image forming apparatus comprising:

a storage unit to store different color registration patterns having different lengths for a plurality of operation modes for color registration;

a controller to select stored color registration patterns of a different length according to a current operation mode so as to perform the color registration; and a printer to print the selected color registration patterns onto a transfer belt, wherein the plurality of operation modes includes a first operation mode in which the color registration is performed under a condition of replacement of a consumable part and a second operation mode in which the color registration is performed under a condition other than replacement of a consumable part, wherein a length of the color registration pattern of the second operation mode is set to be shorter than a length of the color registration pattern of the first operation mode, wherein the length of the color registration pattern is a length of an X-axis direction perpendicular to a transfer direction of the transfer belt.

12. The image forming apparatus according to claim 11, wherein the color registration patterns are offset correction patterns for a plurality of colors for use in the color registration.

13. The image forming apparatus according to claim 12, wherein the offset correction patterns include a color registration pattern for X-axis offset correction in the first operation mode and a color registration pattern for X-axis offset correction in the second operation mode.

14. The image forming apparatus according to claim 11, wherein the controller measures a velocity change of the transfer belt and performs the color registration by changing positions of the color registration patterns according to the velocity change of the transfer belt.

15. The color registration method according to claim 7, wherein the length of the color registration pattern of the second operation mode is set to be shorter than the length D of the color registration pattern of the first operation mode.

* * * * *

UNITED STATES PATENT AND TRADEMARK OFFICE

CERTIFICATE OF CORRECTION

PATENT NO. : 8,521,072 B2
APPLICATION NO. : 12/654972
DATED : August 27, 2013
INVENTOR(S) : Yong Ho You et al.

It is certified that error appears in the above-identified patent and that said Letters Patent is hereby corrected as shown below:

In the Claims

In Column 10, Line 35, In Claim 10, after "according" insert -- to --.

Signed and Sealed this
Eighteenth Day of February, 2014

Michelle K. Lee

Michelle K. Lee
*Deputy Director of the United States Patent and Trademark Office*